US005657517A

United States Patent [19]

Akeno et al.

[11] Patent Number: 5,657,517

[45] Date of Patent: Aug. 19, 1997

[54] HOOK STRUCTURE FOR MOLDED SURFACE FASTENER

[75] Inventors: Mitsuru Akeno; Ryuichi Murasaki; Shinichi Daijyogo; Tsuyoshi Minato, all of Toyama-ken, Japan

[73] Assignee: YKK Corporation, Tokyo, Japan

[21] Appl. No.: 551,044

[22] Filed: Oct. 31, 1995

[30] Foreign Application Priority Data

Nov. 1, 1994 [JP] Japan ..... 6-268489

[51] Int. Cl.[6] ..... A44B 18/00

[52] U.S. Cl. ..... 24/452; 24/442; 24/449

[58] Field of Search ..... 24/452, 442, 446, 24/447, 448, 449, 450, 451; 428/100

[56] References Cited

U.S. PATENT DOCUMENTS

D. 374,609 10/1996 Akeno .
D. 374,813 10/1996 Akeno .
3,708,833 1/1973 Ribich et al. .
5,131,119 7/1992 Murasaki et al. ..... 24/452
5,339,499 8/1994 Kennedy et al. ..... 24/452
5,361,462 11/1994 Murasaki ..... 24/452
5,457,856 10/1995 Murasaki ..... 24/452

FOREIGN PATENT DOCUMENTS

0702909A2 3/1996 European Pat. Off. .
2129663 10/1972 France .

*Primary Examiner*—Peter M. Cuomo
*Assistant Examiner*—Hanh V. Tran
*Attorney, Agent, or Firm*—Hill, Steadman & Simpson

[57] ABSTRACT

In a molded surface fastener, a hook has vertical multi-step reinforcing ribs on opposite side surfaces of a stem, and it is therefore possible to make the hook-shape engaging portion adequately soft and to increase the rate of engagement with loops. Further, since each reinforcing rib extends to the curve of the hook-shape engaging portion, it is possible to secure a predetermined degree of engaging force, despite the thin and soft hook-shape engaging portion, unlike the simple reinforcing ribs of the conventional art.

10 Claims, 7 Drawing Sheets

HOOK STRUCTURE FOR MOLDED SURFACE FASTENER

BACKGROUND OF THE INVENTION

1. Field of the Invention

This invention relates to a molded surface fastener in which a multiplicity of hooks are molded on a substrate sheet by extrusion or injection molding using thermoplastic synthetic resin, and more particularly to a molded hook structure which has both adequate softness and strength of monofilament and is very durable.

2. Description of the Related Art

Surface fasteners of the type in which hooks are formed by weaving monofilaments in a woven cloth so as to form loop piles of monofilaments and then cutting the loop piles are well known in the art. This type surface fastener has softness of a woven cloth and softness of monofilament and is characterized in that the hooked surface fastener comes into engagement with and are peeled off loops of a companion surface fastener with a very smooth touch. Since the monofilaments constituting the hooks are treated by drawings, the surface fastener is excellent in pulling strength and bending strength even in a small cross-sectional area. Further, since the surface fastener can have a very high density of hooks depending on the woven structure, it is possible to secure a high engaging rate and an adequate degree of durability. However, with the woven type surface fastener, since consumption of material and a number of processing steps are large, it is difficult to reduce the cost of production.

For an improvement, a molded type surface fastener was developed in which a substrate sheet and hooks are formed integrally and simultaneously by extrusion or injection molding. A typical example of molding technology for this type surface fastener is disclosed in, for example, U.S. Pat. No. 3,312,583 and WO 87/06522. As a rotary drum in which a number of molding disks each having on an outer peripheral edge of each of opposite surfaces a number of hook-forming cavities and a number of spacer disks each having flat surfaces are alternately superimposed one over another is rotated, molten synthetic resin material is forced against its peripheral surface to fill the cavities and then the hooks formed in the cavities are removed off the drum along with the substrate sheet. The spacer disks are disposed between the molding disks because the cavities of the whole shape of the hooks cannot be made in one mold due to the shape of the hooks.

However, in the molded type surface fastener, partly since a delicate shape cannot be obtained as compared to the woven type surface fastener due to technical difficulty in molding process, and partly since the formed hooks are poor in orientation of molecules, only a very low degree of strength can be achieved with the same size of the above-mentioned monofilament hooks. Therefore none of the conventional molded type surface fasteners are satisfactory for practical use. Further, according to the conventional hook structure, the individual stem is simple in cross-sectional shape and would hence tend to fall flat from its base. As a result, the individual stems would not restore their original posture after repeated use, thus lowering the rate of engagement with loops of a companion surface fastener. Therefore, in order to secure desired strength, it is absolutely necessary to increase the size of the individual hooks, which makes the hooks rigid and the number of hooks per unit area (density of hooks) reduced to lower the rate of engagement with the companion loops.

As a solution, a new hook structure which enables a smooth touch, with the stem hardly falling flat, during the engaging and peeling operation likewise the woven type surface fastener and which increases the rate of engagement to secure adequate strength and durability is disclosed in, for example, U.S. Pat. No. 5,131,119. In the molded type surface fastener disclosed in this U.S. Patent, each hook has a hook-shape engaging portion extending forwardly from the distal end of a stem, which has a rear surface rising obliquely in a smooth curve from a substrate sheet and a front surface rising upwardly from the substrate sheet, and a reinforcing rib projecting from a side surface of the stem, the cross-sectional area of the hook increasing gradually from a tip of the hook-shape engaging portion toward the base of the stem. The reinforcing rib serves to prevent the stem from falling laterally and also to minimize the stem and the hook-shape engaging portion while maintaining a required degree of engaging strength. The height of the reinforcing rib is substantially equal to a half of the height of the tip of the hook-shape engaging portion.

U.S. Pat. No. 5,339,499 also discloses a hook structure in which a reinforcing rib having the same thickness as that of a hook and extending upwardly beyond the height of the tip of a hook-like engaging portion is situated on one side surface of the hook.

However, according to U.S. Pat. No. 5,131,119, because of the above-mentioned shape of the reinforcing rib, both a hook-side surface and a rear surface of the hook-shape engaging portion above the apex of the reinforcing rib are subject to large local force due to being stretched and depressed. Therefore, if the force is exerted to the hook-shape engaging portion repeatedly, a portion around the apex of the reinforcing rib becomes weak and the hook tends to get cut at that portion.

The shape of the reinforcing rib disclosed in U.S. Pat. No. 5,339,499 is identical with the shape of the stem of the hook as seen in side view. The whole shape of the hook corresponds to the shape in which one of laterally divided halves of a single hook-shape engaging portion is removed. Specifically, in the conventional molded hook structure devoid of a reinforcing rib, the hook except the stem and a base of the hook-shape engaging portion is laterally divided into halves, and one half is removed to reduce the thickness of the hook-shape engaging portion. Thus the hook-shape engaging portion is reduced to half in thickness and is hence deformable while the stem has the same degree of rigidness as conventional.

Application of this kind of molded surface fasteners is on the increase for use in paper diapers and underwear for babies, and hooks having improved softness are cherished. There is a limit in selecting the material for such softness, and adequate softness should necessarily depend on a rational structure of the hook.

However, in the hook structure disclosed in U.S. Pat. No. 5,131,119, if the hook is too thin, the reinforcing rib has only a too small height so that the hook is too soft not only in the hook-shape engaging portion but also in the joint between the stem and the hook-shape engaging portion. The hook is accordingly tends to flex at the joint to lower the rate of engagement with the loops to the utmost.

Further, in the hook structure disclosed in U.S. Pat. No. 5,339,499, the reinforcing rib is identical in side shape with the hook throughout the stem and part of the hook-shape engaging portion, the almost whole of the hook has the same thickness as conventional. It is therefore impossible to avoid a rigid touch when the user's skin comes into direct or indirect contact with the hooks. Also, since the entire hook except the hook-shape engaging portion has a uniform thickness, in order to make the hook in whole flexible, it is inevitable to reduce the thickness of the stem, which is double the thickness of the hook-shape engaging portion, and the thickness of part of the hook-shape engaging portion as well as the thickness of the majority of the hook engaging portion. The resulting hook is very apt to fall flat sideways, lowing the rate of engagement with the companion loops to the utmost.

SUMMARY OF THE INVENTION

It is therefore an object of this invention to provide a hook structure, for a surface fastener, which has an adequate degree of durability for repeated use while the hook in whole has an adequate degree of softness, not only preventing the hook from falling laterally to the extremity but also holding a high rate of engagement with a loop of the companion surface fastener.

According to this invention, the above object is accomplished by a molded surface fastener comprising a substrate sheet and a multiplicity of hooks molded on and projecting from one surface of the substrate sheet, each of the hooks being composed of a stem having a rear surface rising obliquely in a smooth curve from the substrate sheet and a front surface rising upwardly from the substrate sheet, a hook-shape engaging portion extending forwardly from a distal end of the stem, and a reinforcing rib situated on at least one side surface of the stem and rising perpendicularly from the substrate sheet so as to range from a base end of the stem to part of the hook-shape engaging portion. The reinforcing rib is in a multi-step form from an apex to a stem thereof, the apex of at least a first-step rib member of the reinforcing rib, which is highest and nearest to the stem, being situated upwardly of a line tangent to a curve of the hook-shape engaging portion at a tip thereof and substantially parallel to the one side surface of the substrate sheet.

Preferably, the reinforcing rib rises substantially centrally from the base of the stem, and the ratio of a back-and-forth width of the reinforcing rib to a back-and-forth width of the stem along a straight line parallel to the surface of the substrate sheet and passing a central point of the stem ranges from 1:5 to 1:2.

Further, the reinforcing ribs are situated at opposite sides of the stem of each hook, the reinforcing ribs having a shape identical with or different from each other. In the case of different shapes, one of the reinforcing ribs which are provided on opposite sides of the hook is smaller in height than the other reinforcing rib.

Generally, the reinforcing rib rises perpendicularly and substantially centrally from the base end of the stem, the reinforcing rib having a varying width gradually increasing from a substantially central position of the stem to the base end. In a modified form, the first-step rib member of the reinforcing rib rises perpendicularly and substantially centrally from the base end of the stem and extends, together with the curve of the hook-shape engaging portion, from a substantially central position in a heightwise direction to an upper end of each hook along a center line of the hook. In another modified form, the first-step rib member of the reinforcing rib rises obliquely and substantially centrally from the base end of the stem along a center line of each hook and extends, together with the curve, to the vicinity of the tip of the hook-shape engaging portion along the center line of the hook, the first-step rib member gradually decreasing in width and thickness from the base end to the tip.

In the case where the reinforcing ribs are situated on opposite sides of the stem, the bottom-step rib members of the adjacent rows of the hooks are integrally connected with each other.

The hook has a varying cross-sectional area gradually increasing from the distal end of the stem to the base end of the stem.

In operation, the vertical multi-step reinforcing ribs of this invention serve to prevent the hook from falling flat sideways. With the reinforcing ribs of the invention, when the hook is pressed from the above by the loop, the hook falls flat gradually in steps from the upper side so that the hook-shape engaging portion extends sideways in steps along a loop on the side. Besides, since the thickness of the hook is largest at the bottom-step rib member existing at the base end, lateral bending does not occur at the base end so that the loop is apt to come to the base end to catch the hook-engaging portion surely, increasing the rate of engagement.

Further, since the upper end of the first-step rib member extends to halfway of the curve of the hook-shape engaging portion, while maintaining adequate softness of the hook-shape engaging portion, the loop would hardly be removed from the hook-shape engaging portion, thus guaranteeing a predetermined engaging force. Specifically, as the loop is pulled upwardly when removing the loop from the hook-shape engaging portion, the hook is free from bending at the curve of the hook-shape engaging portion since the first step rib member extends to halfway of the curve. Therefore, the curved shape of the hook-shape engaging portion is sustained even if the loop is pulled upwardly, so the loop cannot be removed easily. Although an reaction at that time is small for the individual hook, it would be very large for the entire surface fastener to obtain a predetermined peeling force.

Preferably, the reinforcing rib rises substantially centrally from the base of the stem, and the ratio of a back-and-forth width of the reinforcing rib to a back-and-forth width of the stem along a straight line parallel to the surface of the substrate sheet and passing a central point of the stem ranges from 1:5 to 1:2. The thickness around the reinforcing rib may be the same as that of the stem and the hook-shape engaging portion. If the ratio is smaller than 1:5, the reinforcing ribs would not have the original reinforcing function. If the ratio exceeds 1:2, the entire hook would be rigid due to the rigidness of the reinforcing ribs. With the reinforcing ribs of this invention, partly since the soft stem and hook-shape engaging portion around the reinforcing ribs are in the form of a fin, the portion of the hook around the reinforcing ribs including the hook-shape engaging portion has an increased softness so that an excellent touch can be obtained when a surface fastener having the hook structure is used in an underwear, giving no injuries to the user.

Further, in the case where the reinforcing ribs are situated respectively on opposite sides of the stem with adjacent bottom-step rib members integrally connected, the substrate sheet would hardly be torn between the hook rows.

DETAILED DESCRIPTION OF THE PREFERRED EMBODIMENTS

Figure 1A:
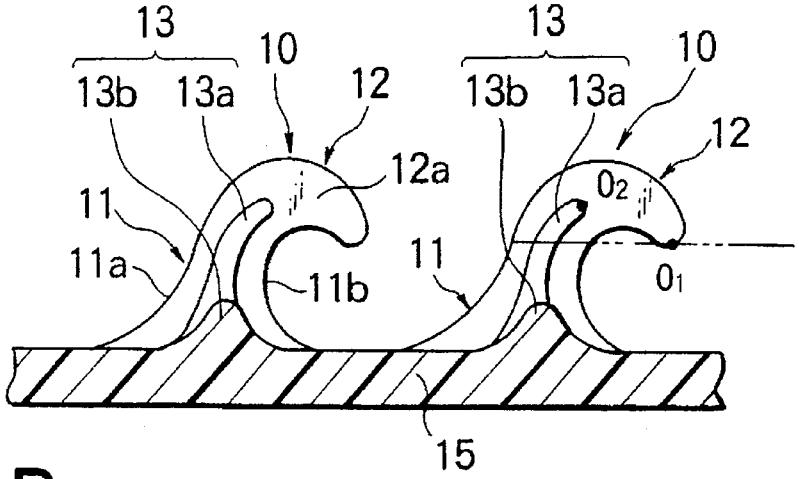
FIGS. 1(A) 1(B) and 1(C) are cross-sectional views of a molded surface fastener, showing a hook structure and arrangement according to an embodiment of this invention.
Figure 1B:
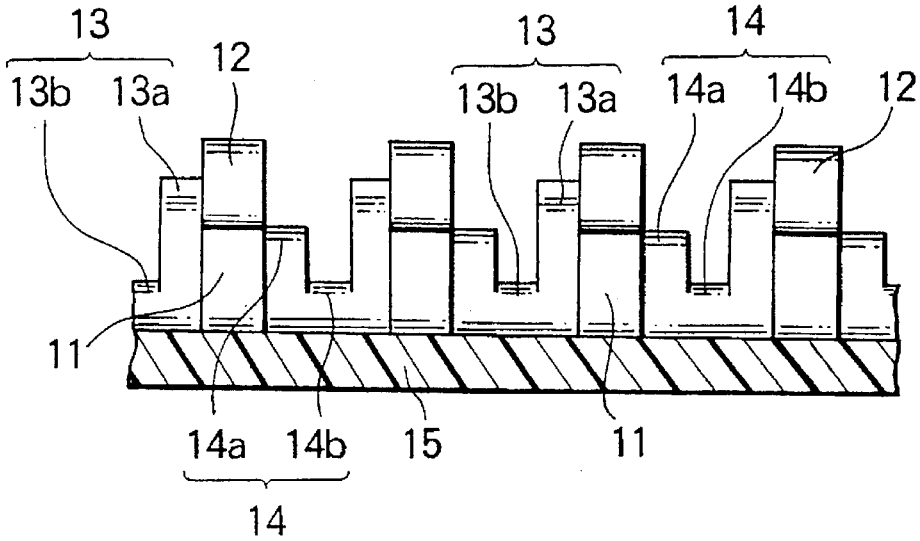
Figure 1C:
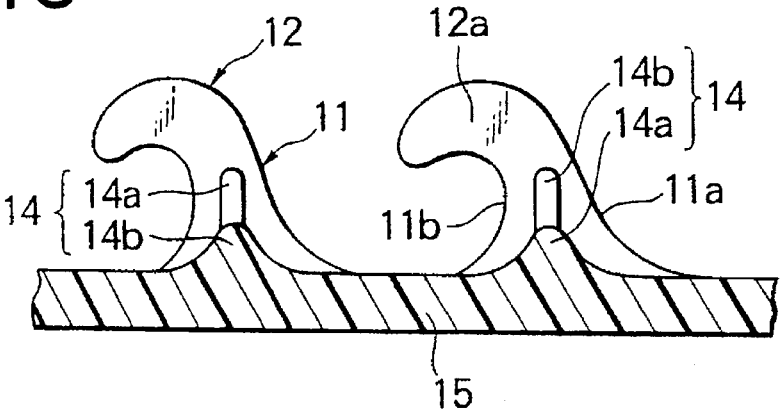

Various preferred embodiments of this invention will now be described in detail with reference to the accompanying drawings. FIGS. 1(A), 1(B) and 1(C) are a fragmentary side view, a front view and another side view, respectively, of a molded surface fastener having a hook structure according to a typical embodiment of the invention.

As shown in FIGS. 1, a hook 10 has a stem 11, which has a rear surface 11*a* rising obliquely in a smooth curve from a substrate sheet 15 and a front surface 11*b* rising upwardly from the substrate sheet 15, and a hook-shape engaging portion 12 extending forwardly and curving downwardly from a distal end of the stem 11. Further, the hook 10 has on one side surface a first reinforcing rib 13 perpendicularly rising from a base of the stem 11 to the hook-shape engaging portion 12.

As a first characteristic feature of this invention, the first reinforcing rib 13 has a multi-step form composed of a vertical succession of steps of rib members. In the illustrated example, the first reinforcing rib 13 has a double-step form composed of a first-step rib member 13*a* and a second-step rib member 13*b*. The first-step rib member 13*a* extends from the base of the stem 11 to a curve 12*a* of the hook-shape engaging portion 12 and has a back-and-forth width uniform from a substantially central position of the stem 11 to an upper end and gradually increasing from a substantially central position of the stem 11 to the stem base. The second-step rib member 13*b* has a generally chevron shape same as that of a side surface of the first-step rib member 13*a*, projecting from the side surface of the first-step rib member 13*a*. An apex $\mathbf{0}_2$ of the first-step rib member 13*a* is situated above a line tangential to the hook-shape engaging portion 12 at the tip $\mathbf{0}_1$ and substantially parallel to the upper surface of the substrate sheet 15. The thickness of the first reinforcing rib 13 may be selected as desired, and usually the thickness of each step rib member 13*a*, 13*b* may be smaller than the thickness of the stem 11.

In addition, the first reinforcing rib 13 rises substantially centrally from the base of the stem 11, and the ratio of a back-and-forth width of the reinforcing rib 13 to a back-and-forth width of the stem 11 along a straight line parallel to the surface of the substrate sheet and passing a central point of the stem ranges from 1:5 to 1:2. And the front and back parts of the first reinforcing rib 13 has the same thickness which is smaller than a portion having the first reinforcing rib 13. If the ratio is smaller than 1:5, the reinforcing ribs would not have the original reinforcing function. If the ratio exceeds 1:2, the entire hook would be rigid due to the rigidness of the reinforcing ribs. According to the reinforcing ribs of this invention, partly since the soft stem 11 and hook-shape engaging portion 12 around the reinforcing rib 13 are in the form of a fin, the portion of the hook around the reinforcing ribs including the hook-shape engaging portion 12 has an increased softness so that an excellent touch can be obtained when a surface fastener having the hook structure is used in an underwear, giving no injuries to the user.

Further, as shown in FIG. 1(C), the hook 10 has a second reinforcing rib 14 on the other side surface of the stem 11. The second reinforcing rib 14 is a double-step form having a vertical succession of first-step and second-step rib members 14*a*, 14*b*. The height of the first-step rib member 14*a* corresponding to the first-step rib member 13*a* is substantially equal to the height of the tip of the hook-shape engaging portion 12 and is smaller than the first-step rib member 13*a* on the opposite side surface of the stem 11. The second-step rib member 14*b* has the same chevron shape with the second-step rib member 13*b* on the opposite side surface of the stem 11 and is integrally connected with the second-step rib member 13*b* of an adjacent hook 10 at their confronting side surfaces. With the adjacent second-step rib members 13*b*, 14*b* connected with each other, the surface fastener is prevented from being torn locally in the substrate sheet between adjacent hook rows.

In the presence of the multi-step reinforcing ribs 13, 14, the hook 10 is prevented from falling flat laterally. On the contrary, in the prior art hook structure disclosed in U.S. Pat. No. 5,131,119, when the hooks are depressed from the upper side by a companion surface fastener having loops as engaging elements, the hook-shape engaging portion together with the stem will fall laterally at once from the upper end of the reinforcing rib to bump off the loop to be engaged so that no engagement with the loop can be achieved. In the prior art hook structure disclosed in U.S. Pat. No. 5,339,499, when the hooks with the reinforcing rib having a predetermined degree of flexibility are depressed by the loops, it is impossible to estimate the position from which the reinforcing rib will fall laterally, and as a result, many of the ribs tend to fall laterally from their bases. In such event, it is highly likely that the loops to be engaged, will be bumped off sideways due to the bending force as they are in the above-mentioned prior art, and even the loops in engagement with the hook-shape engaging portions are not introduced to the bases of the hooks and will therefore come out of engagement with the hooks.

According to the reinforcing ribs 13, 14, when the hook 10 is pressed from the above by the loop, the hook 10 falls flat gradually in steps from the upper side so that the hook-shape engaging portion 12 falls sideways in steps along a loop on the side. Besides, since the thickness of the hook is largest at the bottom-step rib member (the second-step rib member 13*b* in the illustrated example) existing at the base end, lateral bending does not occur at the base end so that the loop 10 is apt to come to the base end to catch the hook-engaging portion 12 surely, increasing the rate of engagement.

As a second characteristic feature of this invention, since the upper end of the first-step rib member 13*a* extends to halfway of the curve 12*a* of the hook-shape engaging portion 12, while maintaining adequate softness of the hook-shape engaging portion 12, the loop would hardly be removed from the hook-shape engaging portion 12, thus guaranteeing a predetermined engaging force. Specifically, if the entire hook-shape engaging portion which is connected to the thick stem via a neck is made to be thin like the hook structure disclosed in U.S. Pat. No. 5,339,499, as the loop is pulled upwardly when removing the loop from the hook-shape engaging portion 12, the loops is easily disengaged from the hook because the entire hook-shape engaging portion 12 is extremely flexible. To the contrary, according to the invention, the hook is free from bending at the curve 12*a* of the hook-shape engaging portion 12 since the first-step rib member 13*a* extend to halfway of the curve 12*a*. Therefore, the curved shape of the hook-shape engaging portion 12 is sustained even if the loop is pulled upwardly, so the loop cannot be removed easily. Although an reaction at that time is small for the individual hook 10, it would be very large for the entire surface fastener to obtain a predetermined peeling force.

FIGS. 2(A) through 9 show various modifications of the hook structure of the foregoing embodiment; parts or elements corresponding to those of the embodiment of FIGS. 1(A), 1(B) and 1(C) are designated by the same reference numerals.

Figure 2A:
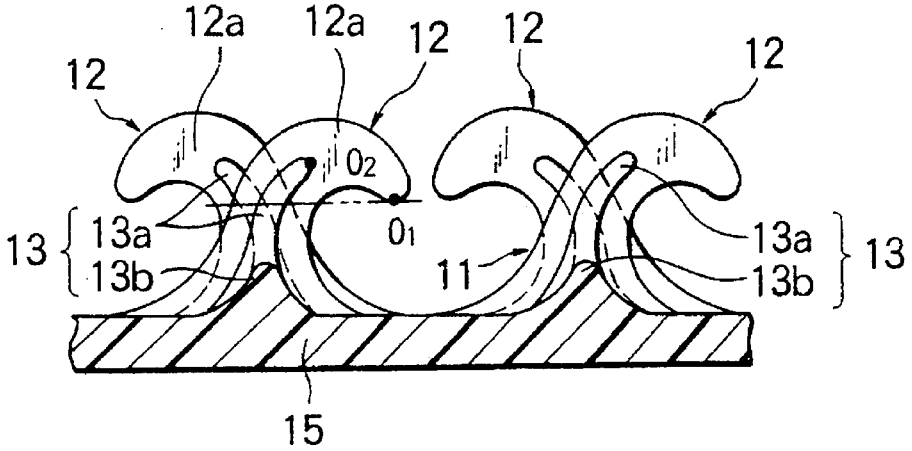
FIGS 2(A) and 2(B) show an example of a hook arrangement of this invention.
Figure 2B:
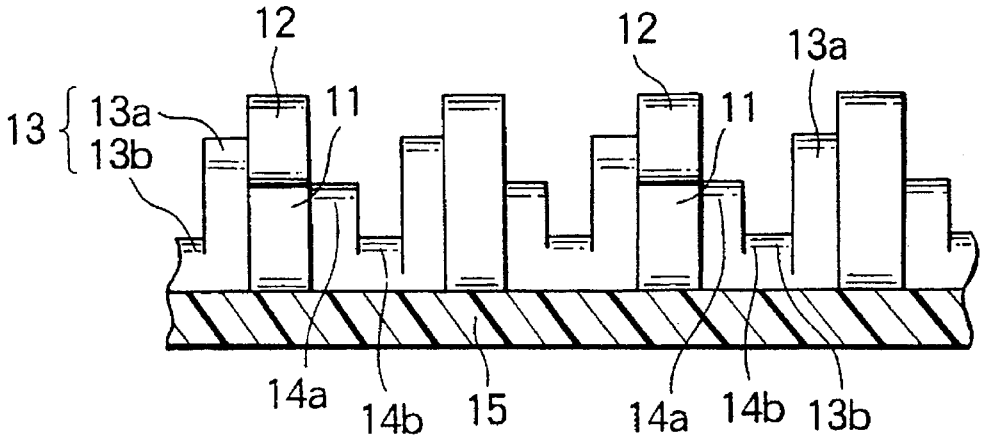
Figure 3A:
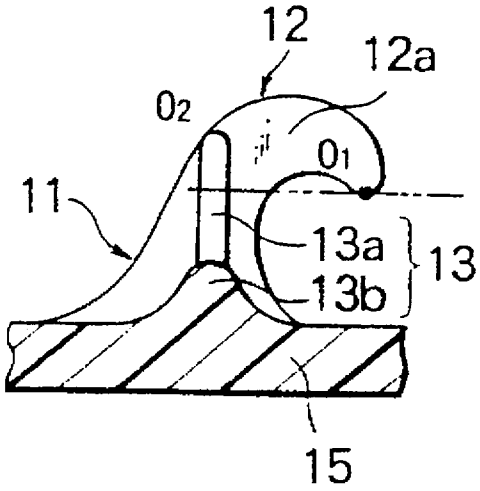
FIGS. 3(A), 3(B) and 3(C) show a first modification of the hook.
Figure 3B:
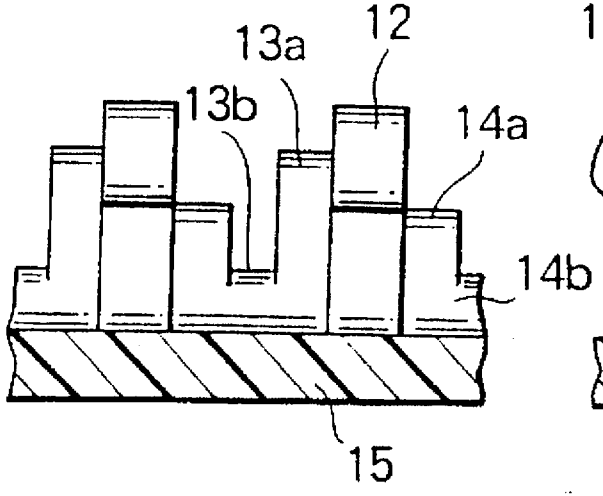
Figure 3C:
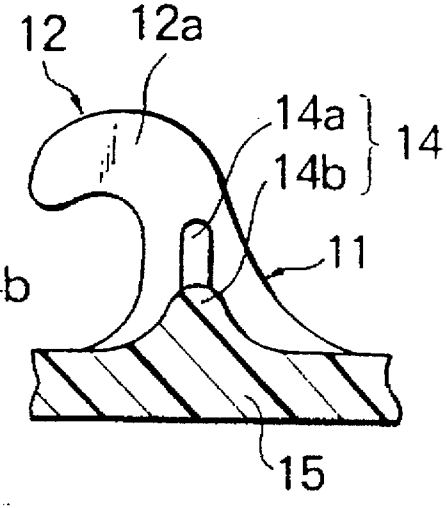

In the modification of FIGS. 2(A) and 2(B), the structure of the individual hook 10 is identical with that of the embodiment of FIGS. 1(A), 1(B) and 1(C) except that the directions of two adjacent rows of the hooks 10 are opposite. In the modification of FIGS. 3(A), 3(B) and 3(C), the first-step rib member 13*a* rises vertically to the upper surface of the hook-shape engaging portion 12. In the modifications shown in FIGS. 2(A), 2(B), 3(A), 3(B) and 3(C), the individual hook 10 has substantially the same function as the hook 10 of the foregoing embodiment. But in the modification of FIGS. 2(A) and 2(B), two opposite engaging direction are provided, and in the modification of FIGS. 3(A), 3(B) and 3(C), as compared to the embodiment of FIGS. 1(A), 1(B) and 1(C), although less portion of the curve 12*a* of the hook-shape engaging portion 12 has the first-step rib member 13*a* and hence has a poorer engaging force, it is possible to improve the rate of engagement with loops as the hooks 10 are prevented not only from falling flat laterally but from falling flat forwardly.

Figure 4A:
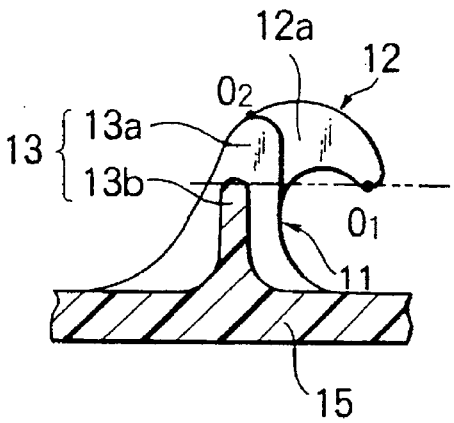
FIGS. 4(A) and 4(B) show a second modification of the hook.
Figure 4B:
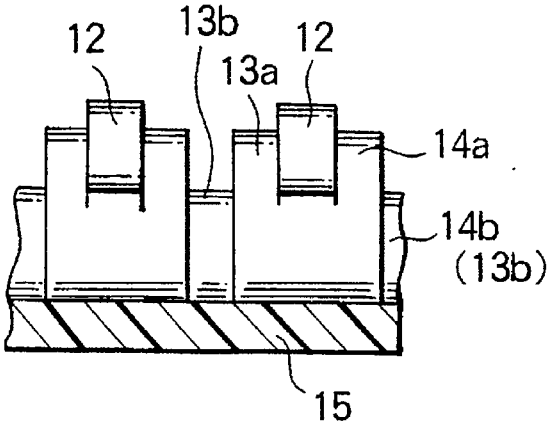

In the modification of FIGS. 4(A) and 4(B), the first-step rib member 13*a* is identical in side shape with the stem 11 and extends vertically to the upper surface of the hook-shape engaging portion 12, while the second-step rib member 13*b* is not a mere chevron shape as shown in FIG 1(A) but extends vertically upwardly with a back-and-forth width uniform from its top to the base and substantially equal to that of the first-step rib member 13*a* of FIG. 1(A). The height of the second-step rib member 13*b* is substantially equal to that of the tip of the curve 12*a* of the hook-shape engaging portion 12. In this modification, the second reinforcing rib 14 on the opposite side of the stem 11 has the same shape as the first reinforcing rib 13. Since the first-step rib member 13*a* has the same back-and-forth width as that of the stem 11, the hook structure of this modification is more stable than the hook structure of FIGS. 1(A), 1(B) and 1(C) though it is more rigid than the foregoing embodiments of FIGS. 1(A), 1(B) and 1(C).

Figure 5A:
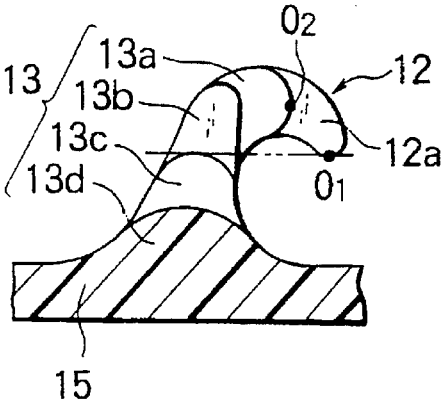
FIGS. 5(A) and 5(B) show a third modification of the hook.
Figure 5B:
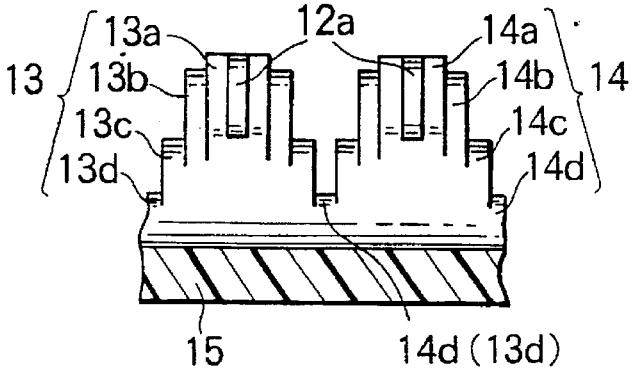
Figure 6:
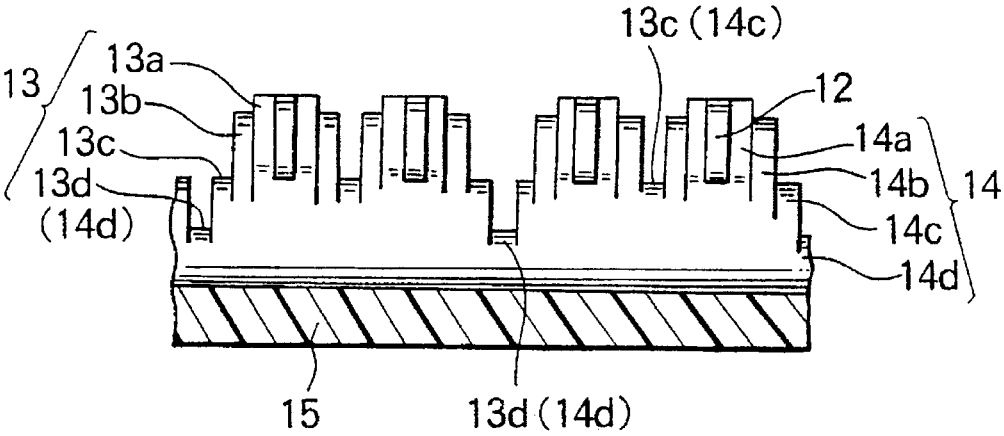
FIG. 6 is a fragmentary front view similar to FIG. 5(B), showing another hook arrangement.

In the modification of FIGS. 5(*a*) and 5(*b*), each of the first and second reinforcing ribs 13, 14 is a multi-step form composed of a number of rib members (four rib members in the illustrated example), and the first-step rib member 13*a*, 14*a* extending to a substantially central position of the curve 12*a* of the hook-shape engaging portion 12. The rib structure of FIG. 6 is similar to that of FIG. 5(B) except that adjacent third-step rib members 13*c*, 14*c* in a pair of adjacent hook rows are joined with each other while adjacent fourth-step rib members 13*d*, 14*d* on the other side are joined with each other. The modified reinforcing ribs 13, 14 of FIGS. 7(A) and 7(B) correspond to those of FIGS. 5(A) and 5(B) except that the first-step and third-step rib members 13*a*, 13*c* and 14*a*, 14*c* are omitted. Accordingly this invention should by no means be limited in rib shape and number of steps. In the modifications of FIGS. 5(A), 5(B) and 6, although the hook 10 are slightly more rigid than that of the embodiment of FIGS. 1(A), 1(B) and 1(C), particularly in the example of FIGS. 5(A) and 5(B), the hook 10 has a varying degree of softness gradually increasing in steps from the base to the tip, thus obtaining an ideal-shape hook structure.

Figure 7B:
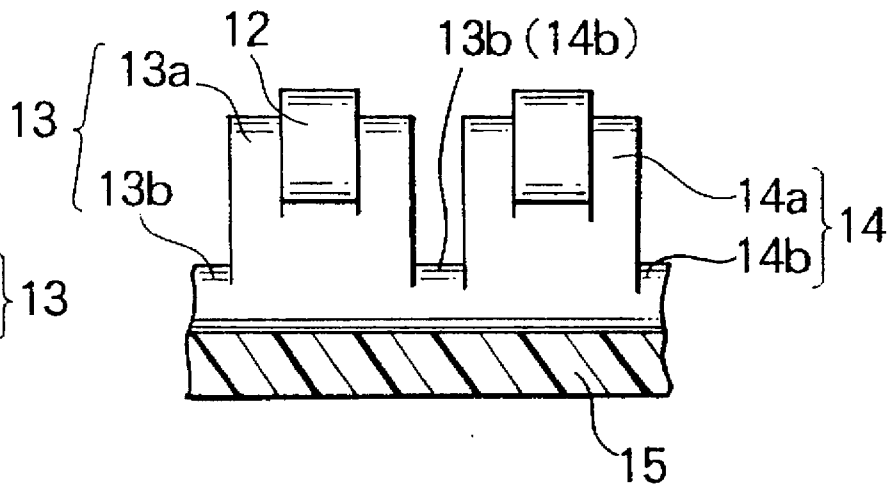
FIGS. 7(A) and 7(B) show a fourth modification of the hook.
Figure 7A:
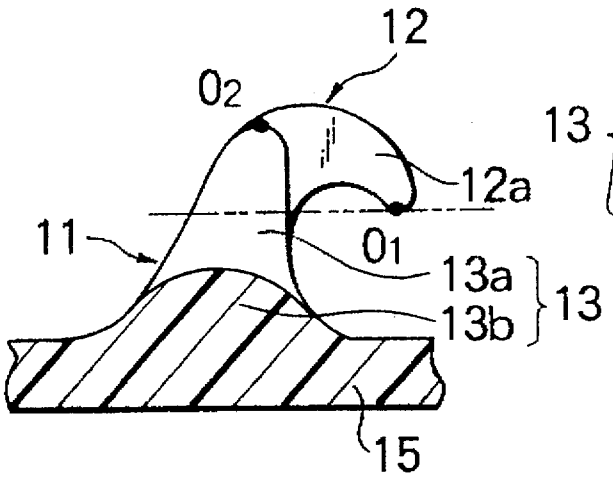
Figure 8A:
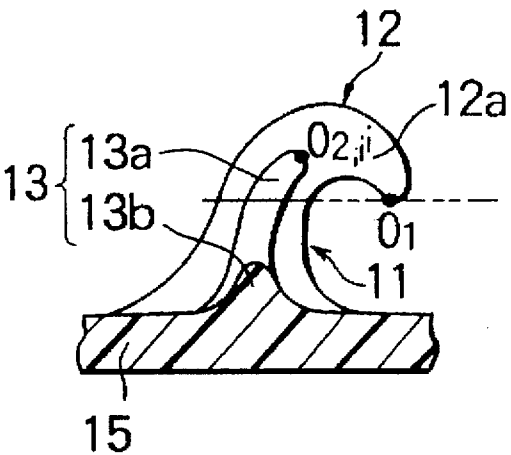
FIGS. 8(A), (8(B) and 8(C) show a fifth modification of the hook.
Figure 8B:
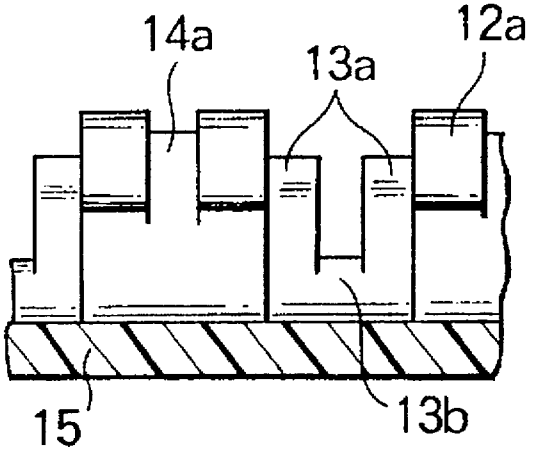
Figure 8C:
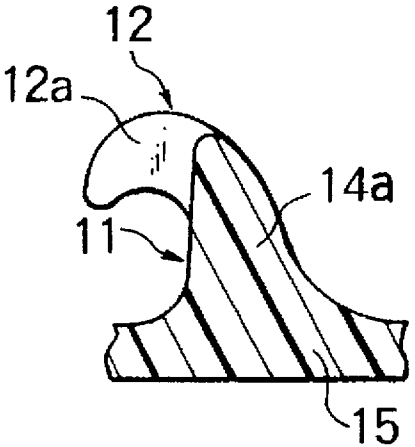

In the modification of FIGS. 8(A), 8(B) and 8(C), the hook 10 has on one side surface a first-step rib member 13*a* of the FIGS. 1(A), 1(B) and 1(C) and on the other side surface a first-step rib member 14*a* of FIGS. 7(A) and 7(B), and on each of opposite sides of the individual hook 10, the confronting second-step rib members 13*b* in a pair of adjacent hook rows are joined with each other while the confronting first-step rib members 14*a* in a pair of adjacent hook rows are joined with each other.

Figure 9C:
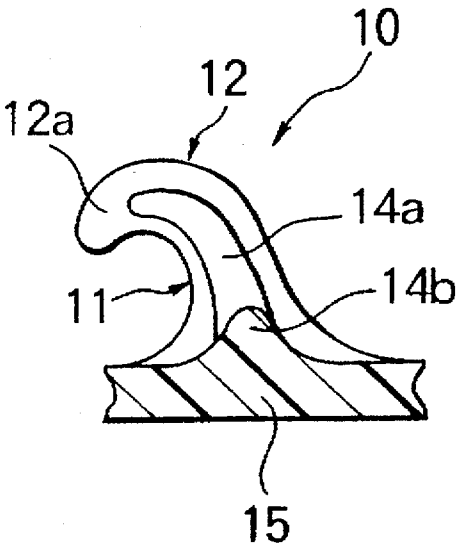
FIGS. 9(A), 9(B) and 9(C) show a sixth modification of the hook.
Figure 9B:
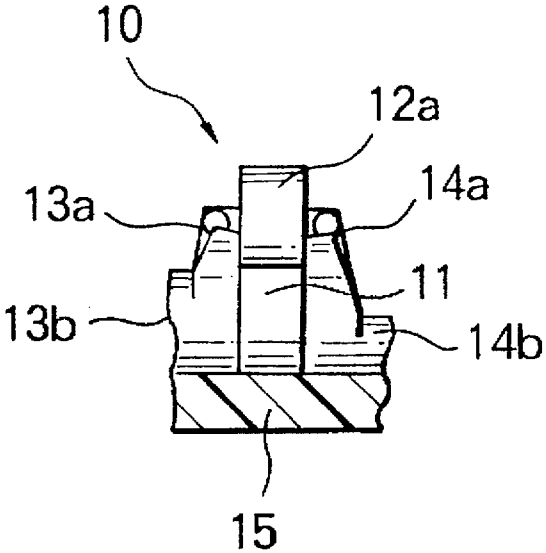
Figure 9A:
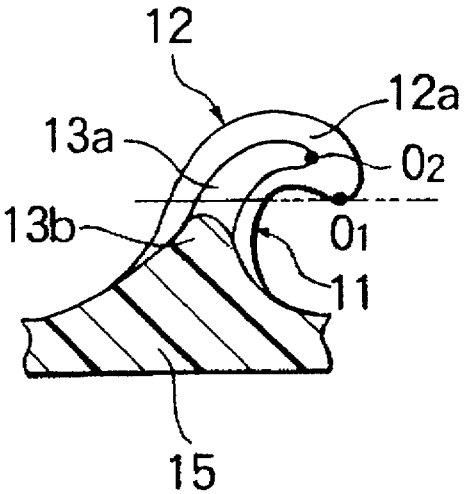

Further, in the modification of FIGS. 9(A), 9(B) and 9(C), the first-step rib member 13*a*, 14*a* on each of opposite side surfaces of the hook 10 is substantially identical in shape with the first-step rib member 13*a* of FIGS. 1(A), 1(B) and 1(C). Further, each of the first-step rib members 13*a*, 14*a* extends to the vicinity of the tip of the hook-shape engaging portion 12 along the curve 12*a* thereof. And the first-step rib member 13*a*, 14*a* has a varying width and thickness gradually decreases from the base to the upper end, and the second-step rib members 13*b*, 14*b* on the opposite side surfaces of the hook 10 are different in shape from each other. Specifically, though both of the second-step rib members 13*b*, 14*b* on either side surface of the hook 10 have a chevron shape, while on the front side of the hook 10, the second-step rib member 13*b* rises obliquely along the front and back surfaces of the base of the hook 10 and has a varying back-and-forth width gradually decreasing toward the upper end, on the back side of the hook 10, the second-step rib member 14*b* has a varying back-and-forth width smaller at its base than the base of the hook 10 and gradually decreasing toward the upper end. Besides, the confronting second-step rib members 13*b* on the opposite side surfaces are joined with each other, and the confronting second-step rib members 14*b* on the opposite side surfaces are joined with each other.

As described above, in this invention, the hook 10 may have the first and second reinforcing ribs 13, 14 in combination, and various changes may be made in shape to the hook structure. Though having minor functional differences depending on the combination and rib shape, these hook structures have a common original function, and a desired function may be obtained by varying the thickness of the stem 11 and/or the hook-shape engaging portion 12, thus meeting a wide range of requirements.

As is apparent from the foregoing description, according to the hook structure of this invention, because of the vertical multi-step reinforcing ribs, it is possible to make the hook-shape engaging portion 12 adequately soft and to increase the rate of engagement with loops simultaneously. Further, since the reinforcing rib 13, 14 extends to the curve 12*a* of the hook-shape engaging portion 12, it is possible to secure a predetermined degree of engaging force, despite the thin and soft hook-shape engaging portion 12*a*, unlike the simple reinforcing ribs of the conventional art. Therefore, by selecting an optimum rib shape and an optimum thickness of individual parts according to the use of the surface fastener, it is possible to apply the surface fastener to various uses, such as paper diapers for infants and underwear, in addition to the conventional uses.

What is claimed is:

1. A molded surface fastener comprising:

(a) a substrate sheet; and (b) a multiplicity of hooks molded on and projecting from one surface of said substrate sheet;

(c) each of said hooks being composed of i) a stem having a rear surface rising obliquely in a smooth curve from said substrate sheet and a front surface rising upwardly from said substrate sheet, ii) a hook-shape engaging portion extending forwardly from a distal end of said stem, and iii) a reinforcing rib situated on one side surface of said stem, said reinforcing rib rising perpendicularly from said substrate sheet so as to range from a base end of said stem to part of said hook-shape engaging portion;

d) said reinforcing rib being in a multi-step form having adjacent first and second rib members extending to different elevations, an apex of at least said first-step rib member of said reinforcing rib, which is highest and nearest to said stem, being situated on said hook-shape engaging portion at a position upwardly of a line tangent to a curve of said hook-shape engaging portion at a tip thereof and said line being substantially parallel to said surface of said substrate sheet.

2. A molded surface fastener according to claim 1, wherein said reinforcing rib rises substantially centrally from the base of said stem, and the ratio of a back-and-forth width of said reinforcing rib to a back-and-forth width of said stem along a straight line parallel to said surface of said substrate sheet and passing a central point of said stem ranges from 1:5 to 1:2.

3. A molded surface fastener according to claim 1, wherein each of said hooks has a further reinforcing rib situated at another side surface of said stem, said reinforcing rib and said further reinforcing rib being identical in shape with each other.

4. A molded surface hastener according to claim 1, wherein each of said hooks has a further reinforcing rib situated at another side surface of said stem, said reinforcing rib and said further reinforcing rib being different in shape from each other.

5. A molded surface fastener according to claim 4, wherein said reinforcing rib and said further reinforcing rib are situated at opposite sides of said stem of each said hook, said further reinforcing rib being smaller in height than the reinforcing rib.

6. A molded surface fastener according to claim 1, wherein said reinforcing rib rises perpendicularly and substantially centrally from the base end of said stem, said reinforcing rib having a varying width gradually increasing from a substantially central position of said stem to said base end.

7. A molded surface fastener according to claim 1, wherein the first-step rib member of said reinforcing rib rises perpendicularly and substantially centrally form the base end of said stem and extends from a substantially central position in a heightwise direction to an upper end of each said hook along a center line of said hook, said reinforcing rib having a varying width gradually increasing from a substantially central position of said stem to said base end.

8. A molded surface fastener according to claim 1, wherein bottom-step rib members of adjacent rows of said hooks are integrally connected with each other.

9. A molded surface fastener according to claim 1, wherein said reinforcing rib has a varying cross-sectional area gradually increasing from the distal end of said stem to the base end of said stem.

10. A molded surface fastener comprising:

(a) a substrate sheet; and (b) a multiplicity of hooks molded on and projecting from one surface of said substrate sheet;

(c) each of said hooks being composed of i) a stem having a rear surface rising obliquely in a smooth curve from said substrate sheet and a front surface rising upwardly from said substrate sheet, ii) a hook-shape engaging portion extending forwardly from a distal end of said stem, and iii) a reinforcing rib situated on one side surface of said stem, said reinforcing rib rising perpendicularly from said substrate sheet so as to range from a base end of said stem to part of said hook-shape engaging portion;

d) said reinforcing rib being in a multi-step form having adjacent first and second rib members extending to different elevations, an apex of at least said first-step rib member of said reinforcing rib, which is highest and nearest to said stem, being situated on said stem at a position upwardly of a line tangent to a curve of said hook-shape engaging portion at a tip thereof and said line being substantially parallel to said surface of said substrate sheet;

wherein the first-step rib member of said reinforcing rib rises obliquely and substantially centrally from the base end of said stem along a center line of each said hook and extend to the vicinity of the tip of said hook-shape engaging portion along the center line of said hook, the first step rib member gradually decreasing in width and thickness from the base end to the tip.

* * * * *